United States Patent [19]

van der Lely

[11] 4,054,014

[45] Oct. 18, 1977

[54] METHODS OF ERECTING PREFABRICATED BUILDINGS AND EQUIPMENT EMPLOYED IN SUCH METHODS

[76] Inventor: Cornelis van der Lely, 7, Bruschenrain, Zug, Switzerland

[21] Appl. No.: 610,292

[22] Filed: Sept. 4, 1975

Related U.S. Application Data

[63] Continuation of Ser. No. 389,740, Aug. 20, 1973, abandoned.

[30] Foreign Application Priority Data

Aug. 21, 1972 Netherlands ..... 7211386

[51] Int. Cl.[2] ..... B65G 67/02

[52] U.S. Cl. ..... 52/745; 214/1 H

[58] Field of Search ..... 214/1 H, 14, 1 S, 38 CA, 214/86 R, 16.4 R; 52/745

[56] References Cited

U.S. PATENT DOCUMENTS

| | | | |
|---|---|---|---|
| 2,499,498 | 3/1950 | Hammond | 52/125 |
| 3,742,660 | 7/1973 | Bierweiler | 52/125 |
| 3,820,664 | 6/1974 | Lewis | 214/14 |

FOREIGN PATENT DOCUMENTS

| | | | |
|---|---|---|---|
| 1,032,784 | 6/1966 | United Kingdom | 52/745 |

*Primary Examiner*—John E. Murtagh

*Attorney, Agent, or Firm*—Mason, Mason & Albright

[57] ABSTRACT

A method of assembling from relatively large and bulky prefabricated building sections, the size being compatible with transportation by transport vehicles on highways, a multistory building by positioning a plurality of the sections side by side to make up a first story at the building site, the first story as seen in plan constituting an elongated rectangle with longer and shorter sides, erecting a hoist member adjacent one of the shorter sides under which a transport vehicle with a section is driven, hoisting the section from the vehicle first vertically to the next floor level and then moving same horizontally by the hoist member to the top of the already assembled first story, temporarily connecting a device for horizontally moving the section to the opposite shorter side of the first floor and connecting a cable therefrom to a pulley connected to the far side of the section whereby the section is shifted across the top of the first story to its desired position by means of the pulley, the process being repeated until the second story is complete whereupon the hoist member is raised by insertion of upright members at the ground level by the vertical distance of one floor, the moving device is connected to the opposite shorter side of the second story, and the next story is assembled on top of the second story in the same manner as the second story, the process being repeated until the entire building with the desired number of stories has been thus assembled.

28 Claims, 6 Drawing Figures

METHODS OF ERECTING PREFABRICATED BUILDINGS AND EQUIPMENT EMPLOYED IN SUCH METHODS

This is a continuing application of application Ser. No. 389,740 filed Aug. 20, 1973 now abandoned.

This invention relates to methods of erecting prefabricated buildings and to equipment employed in such methods.

According to one aspect of the invention, there is provided a method of erecting a prefabricated building from a plurality of three-dimensional building sections or room units, wherein the method comprises the steps of employing lifting means to bring the sections or units to the level of each story of the building and subsequently shifting the sections or units to their appointed positions in said storey or stories, and wherein the building has at least one longer and at least one shorter side as seen in plan view and said lifting means is disposed in the region of the shorter side or one of the shorter sides thereof.

For a better understanding of the invention, and to show how the same may be carried into effect, reference will now be made, by way of example, to the accompanying drawings, in which:

DESCRIPTION OF THE PREFERRED EMBODIMENTS

Figure 1:
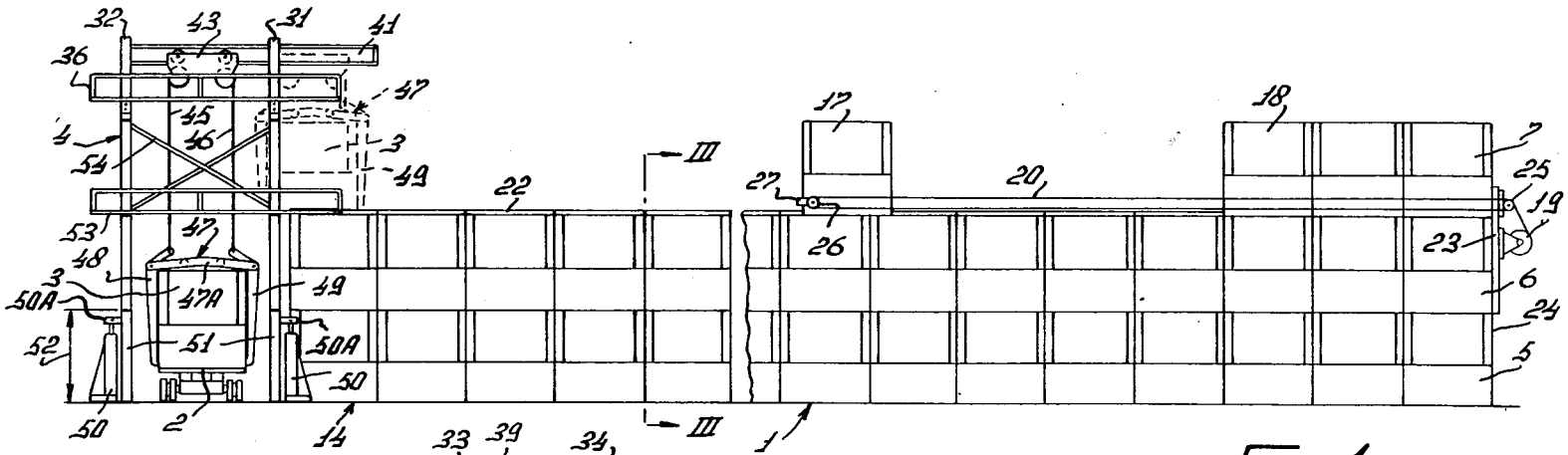
FIG. 1 is an elevation illustrating a prefabricated building in course of erection by a method in accordance with one feature of the invention.

Referring to the drawings, FIG. 1 illustrates part of an elongated prefabricated building that is generally indicated by the reference numeral 1. The building 1 is formed from a plurality of prefabricated three-dimensional building sections or room units of generally box-shaped configuration, these sections or units being carried to the building site from a factory or other place of manufacture by a truck, trailer or other suitable transportation means referred to here as a transporter 2. A typical building section 3 that has been carried to the building site by the transporter 2 is engaged by lifting means 4 so that it may be brought to the level of the story of the building 1 of which it is to form a part for subsequent horizontal displacement to its appointed position in that story. It will be seen from the drawings that the lifting means 4 is located adjacent one of the shorter sides or ends of the building 1 which building is of elongated generally oblong configuration when seen in plan view. FIG. 1 of the drawings shows two completed stories 5 and 6 of the building 1 and an overlying story 7 that is still in the course of assembly.

Each of the stories of the building 1 is afforded wholly or principally by a plurality of prefabricated building sections disposed in successively adjoining relationship with their lengths perpendicular to the length of the complete story of which they form parts. It is only necessary at the building site to arrange the sections in their appointed positions alongside one another and to connect them together where required. Each section is preferably delivered to the building site in a more or less finished condition, a large proportional of the finishing work having been done at the factory or other location of manufacture of the sections, so that only a small number of operations that will take a minimum of time are left to be done at the building site itself.

Figure 3:
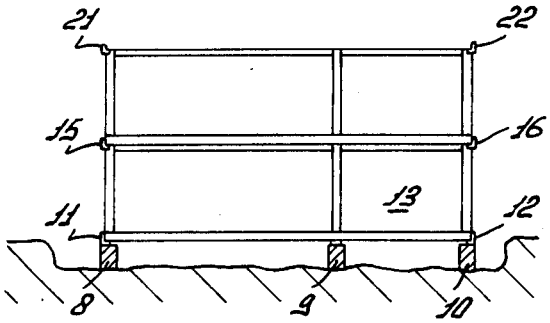
FIG. 3 is a diagrammatic section taken on the line III—III in FIG. 1.

The building sections of the story 5 that affords the ground floor of the building 1 bear downwardly upon foundation beams 8, 9 and 10 (FIG. 3). FIG. 3 of the drawings shows the arrangement only diagrammatically but it will be apparent that the outermost beams 8 and 10 of the three parallel foundation beams 8, 9 and 10 are provided on their upper surfaces with guide beams 11 and 12 of L-shaped cross-section which are so arranged that the ends of a ground floor building section, such as the illustrated section 13, will fit snugly between them. The lifting means 4 that is disposed close to one end 14 (FIG. 1) of the building 1 transfers the various building sections from successive transporters, such as the diagrammatically illustrated transporter 2, onto the foundation beams 8, 9 and 10 after which those sections or units are shifted lengthwise along the horizontal limbs of the guide beams 11 and 12 to their appointed positions in the story 5, the vertical limbs of the beams 11 and 12 providing the required guidance.

Each of the sections or units of the lower story 5 are provided on top with further guide beams 15 and 16 (FIG. 3) of L-shaped cross-section and, when the story 5 is complete, the guide beams 15 and 16 of the juxtaposed building sections co-operate to form a further slideway along which the sections of the story can be shifted. FIG. 1 of the drawings illustrates three building sections 18 of the storey 7 in the appointed positions and also shows a fourth building section 17 being shifted along the top of the story 6 towards a position in which it will adjoin one of the sections 18. All of the sections 17 and 18 are moved to their appointed positions in the story 7 from the aforementioned end 14 of the building. Shifting means in the form of a winch 19 and a co-operating cable 20 are employed to move the section 17 lengthwise along a slideway that is disposed on top of the story 6 and that is afforded by further guide means 21 and 22 (FIGS. 1 and 3 of the drawings), these guide beams being similar in construction and arrangement to the guide beams 15 and 16 and being carried by the tops of the sections of the story 6. The horizontal limbs of the guide beams 21 and 22 afford a supporting slideway for the sections or units 17 and 18 while the vertical limbs thereof provide the required guiding function.

The winch 19 is carried by a support 23 arranged at an end 24 of the stories 5 and 6 of the building 1 that have already been erected, said end 24 of the building 1 being remote from the aforementioned end 14 thereof. The cable 20 extends from the winch 19 around a pulley 25 and thence to a pulley 26 from which it is led back to an anchorage that is rigid with the support 23. The pulley 26 is rotatably mounted on a hook or bracket 27 that is releasably connected to the building section 17 that is to be shifted. It can be seen from FIG. 1 of the drawings that the cable 20 and the pulleys 25 and 26 are all located at one side of the story 7 and it should be particularly noted that these parts are duplicated at the opposite side of the story 7 to ensure that, when the winch 19 is in operation, traction will be applied equally at both short ends of the section 17 to move it reliably in a direction parallel to the geneal plane of FIG. 1 of the drawings. Once the section 17 has reached its appointed position, the hooks or brackets 20 are unwound to allow said hooks or brackets to be brought to the end 14 of the building 1 for re-engagement with a further building section. It will be noted that the hooks or brackets 27 engage the sections, such as the section or unit 17, at the longer sides thereof that are remote from the winch 19, said winch being disposed at the end 24 of the building 1 that is furthest from the end 14 thereof that is adjacent to the lifting means 4.

Figure 2:
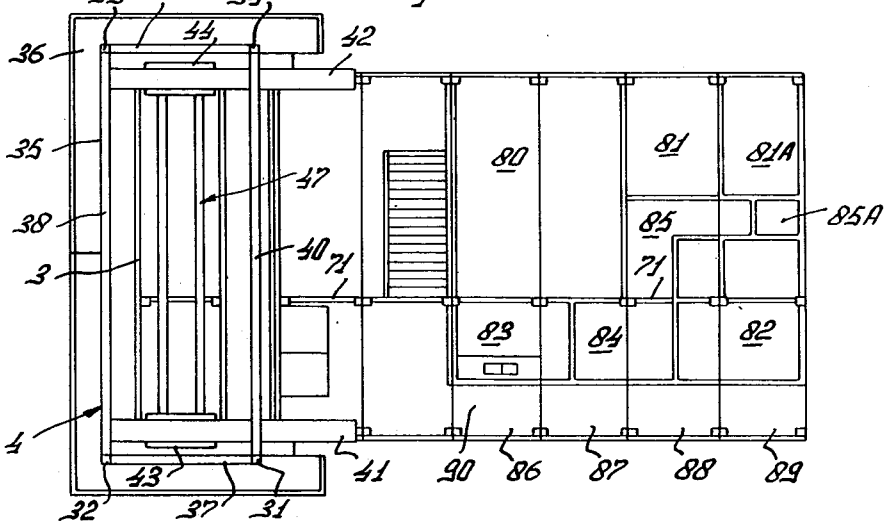
FIG. 2 is a plan view of one end of the building illustrated in FIG. 1.

The lifting means 4 comprises a tower that is of oblong configuration when seen in plan view (FIG. 2). The tower has four vertical columns 31, 32, 33 and 34 at its corners, the distances between these columns being such that the transporter 2 can move between them with sufficient space to enable the building sections, such as the illustrated section, to be lifted off the transporter. The vertical columns 32 and 33 are interconnected by at least one beam at the side 35 of the lifting tower which is remote from the end 14 of the building 1. A bridge or platform 36 is mounted near the top of the lifting tower around the columns 31 to 34 inclusive. The upper ends of the columns 31 to 34 inclusive are interconnected by beams 37, 38, 39 and 40, the beams 38 and 40 being provided with supporting tracks 41 and 42 for trolleys 43 and 44 that can travel lengthwise along the respective supporting tracks 41 and 42. The trolleys 43 and 44 are arranged so as to be capable of being retained in at least one temporarily fixed position that is midway between the beams 38 and 40 as seen in plan view (FIG. 2). Each of the two trolleys 43 and 44 is provided with a corresponding lifting system comprising hoisting cables 45 and 46 so that each section, such as the illustrated section or unit 3, can be raised substantially vertically by the four cables 45 and 46. The trolleys 43 and 44 will normally be in the fixed central position between the beams 38 and 40, as illustrated in FIGS. 1 and 2 of the drawings, when an initial lifting operation from the transporter 2 is being undertaken. Each pair of cables 45 and 46 is provided at the lower ends of those cables with a supporting assembly 47 which comprises arms 48 and 49 that are pivotally connected to an upper portion 47A of the supporting assembly 47. Hook-like extensions at the lower ends of the arms 48 and 49 will automatically engage the section 3 that is to be lifted beneath the bottom of that section. The hook-like extensions in question are visible in FIG. 5 of the drawings.

Figure 5:
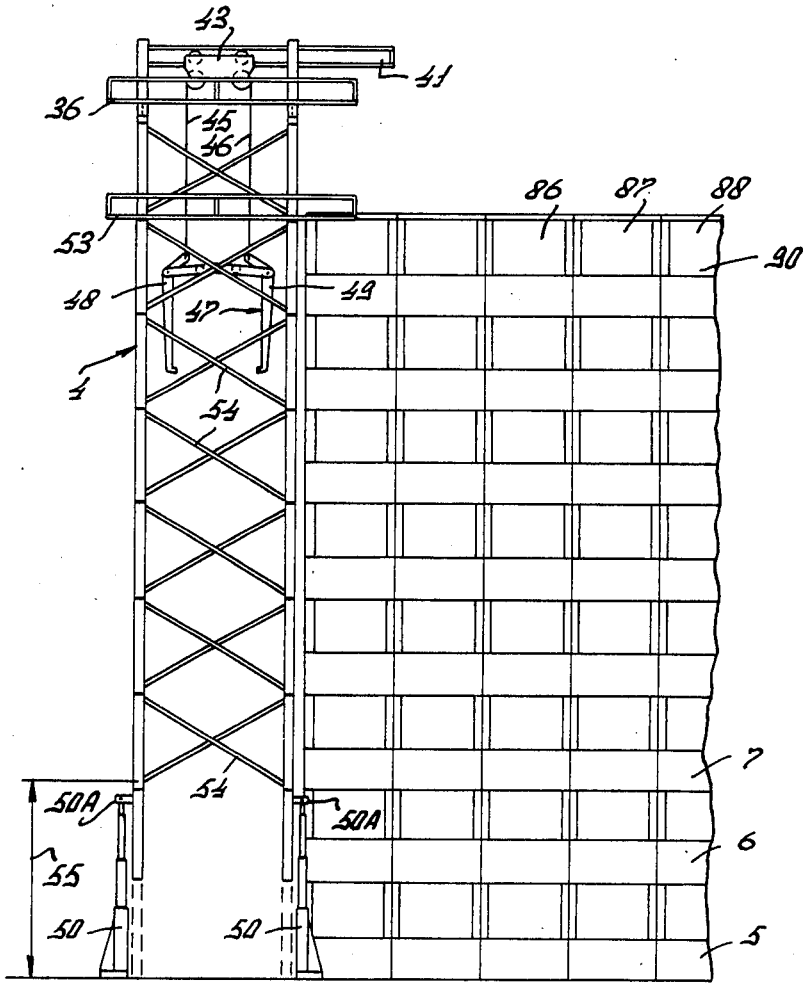
FIG. 5 is an elevation of the left-hand end of the building shown in FIG. 1 but illustrates a later stage in the erection of that building.

As mentioned above, the connections between the columns 31 to 34 inclusive are such that a transporter, such as the illustrated transporter 2, can move readily between them when carrying a typical building section or room unit such as the illustrated section 3. After the section 3 has been lifted from the transporter 2 to the desired level in the building 1, it can be passed between the columns 31 and 34 towards the corresponding story in the building by moving the trolleys 43 and 44 lengthwise along their supporting tracks 41 and 42. The lengths of the tracks 41 and 42 are such that they extend alongside the first sections at the end 14 of the building 1 and this enables a section or unit, such as the section 3, to be placed at the end of the appropriate story, on top of the underlying story, as shown in broken lines in FIG. 1 of the drawings. Once the section 3 has reached substantially the position thereof that is shown in broken lines in FIG. 1 of the drawings and the lifting system has been withdrawn therefrom, it can be indirectly engaged by the cables 20 of the previously described shifting means to move it along the top of the underlying story 6 to its appropriated position in the story 7 as has already been described for the similar building section or room unit 17. The lifting means 4 includes, alongside the lower end of each of the four columns 31 to 34, a lifting device in the form of a jack 50. Each of the four columns 31 to 34 is afforded by a plurality of superposed portions 51 each of which has a height 52 that is equal to the height of one of the story of the building 1. When a multi-story building is to be constructed, the lifting means 4 is erected in the manner shown in FIG. 1. The bridge or platform 36 is arranged near the top of the lifting means 4 at substantially the same level as the trolleys 43 and 44. A further bridge of platform 53 is also connected to the columns 31 to 34 at the level of the top of the last completed story. When a story, such as the story 7, is finished, the height of the lifting tower is raised by inserting fresh portions 51 of the columns 31 to 34 at the bottom of the tower. This can be done by hydraulically extending all of the rams of the four jacks 50 which rams are linked by temporary coupling members 50A to locations close to the tops of the column portions 51 that were previously lowermost. As soon as the jacks 50 are fully extended, the new column sections 51 can be installed at the bottoms of the columns 31 to 34 as shown in broken lines in FIG. 5 of the drawings. FIG. 5 shows the columns 31 to 34 inclusive of the lifting means 4 provided with sufficient portions 51 to enable the lifting means to erect a ninth story of the building 1 on top of the eight storeys that are shown in that figure. The bridges or platforms 36 and 53 project from the lifting tower along the front and rear surfaces of the building 1 throughout distances which are effectively equal to the distances by which the supporting tracks 41 and 42 of the trolleys 43 and 44 project along those surfaces. These distances are substantially the same as the width of a single building section. The maneuvering of a building section onto one end of an underlying completed story of the building 1, as is illustrated in broken lines in FIG. 1 of the drawings, can be effectively controlled and supervised by operatives stationed on the bridges or platforms 36 and 53 and any manhandling of the sections or units that may occasionally be necessary to assist in bringing them to their correct positions can conveniently be effected from those bridges or platforms.

The columns 31 and 32 and also the columns 33 and 34 are interconnected by successive crossed coupling bars 54 above a height 55 (FIG. 5) which is sufficient to enable loaded transporters 2 to enter the bottom of the lifting tower without being impeded by the coupling bars 54. The bars 54 ensure that the lifting tower shall have adequate stability and, if required, further coupling bars (not visible) may be provided to interconnect the columns 32 and 33 or the columns 31 and 34 or both sets of columns beneath the level of the bridge or platform 53.

Figure 4:
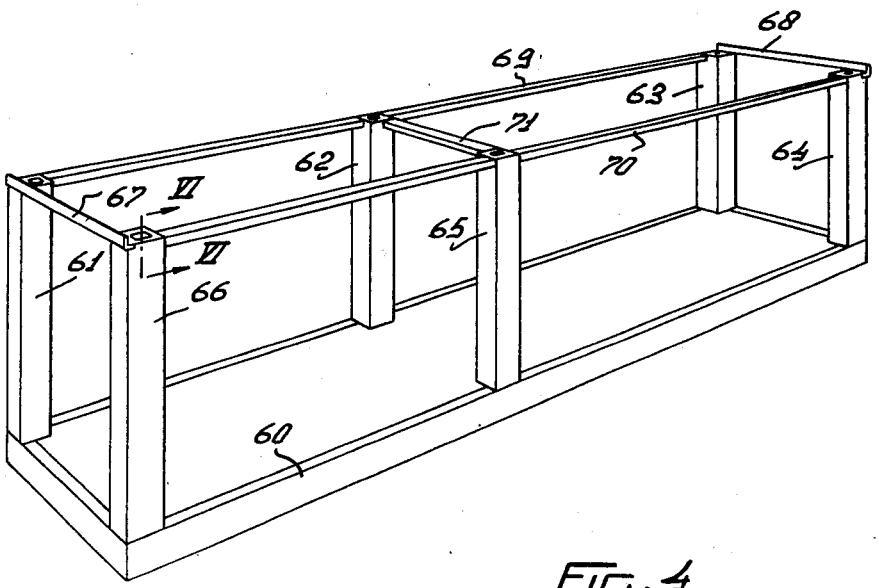
FIG. 4 is a simplified perspective view, to an enlarged scale, illustrating the basic construction of one fabricated building section or room unit for use in a method in accordance with one aspect of the invention.

FIG. 4 of the drawings illustrates a single prefabricated building section somewhat diagrammatically and it will be evident from that figure that the section comprises a floor structure in the form of a panel 60 to which six supporting columns 61, 62, 63, 64, 65 and 66 are secured so as to project perpendicularly upwards from the panel 60. The columns 61 and 66 at one shorter end of the section or unit are interconnected at their upper ends by a horizontal guide beam 67 of L-shaped cross-section and the upper ends of the columns 63 and 64 at the opposite shorter end of the section or unit are interconnected in the same manner by a symmetrically similar guide beam 68. It will be realized that the guide beams 67 and 68 are arranged in the same way, and serve the same function, as the previously described guide beams 15 and 16 of section 13 and guide beams 21 and and 21 of the next higher section as shown in FIG. 3. Interconnecting beams 69 and 70 extend between the upper ends of the columns 61 and 62 and 62 and 63 of one longer side and 64 and 65 and 65 and 66 of the other longer side of the building section and a further interconnecting beam 71, that is parallel to the guide beams 67 and 68, interconnects the upper ends of the columns 62 and 65 at a location between the shorter ends of the section or unit. It will be evident from FIG. 4 of the drawings that the tops of the building sections are substantially completely open but it is emphasized that appropriate walls and other partitions may be provided between the various columns 61 to 66 inclusive as may be dictated by the requirements of the rooms or other spaces that are to be defined internally of the building 1. The building 1 which is illustrated is a dwelling defining a plurality of apartments or flats that may be of different sizes. FIG. 2 shows a single apartment that is afforded by four juxtaposed building sections or room units. The apartment has a living room 80, three bedrooms 81, 81A and 82, a kitchen 83, a hall or vestibule 84, a corridor or passage 85 and a toilet 85A. In order that these rooms and other spaces may be defined merely by placing four building sections 86, 87, 88 and 89 in their correct relative positions, the required inner and outer walls and other partitions are erected in the prefabricated sections before their assembly at the building site. The various inner and outer walls and other partitions can be seen in FIG. 2 of the drawings but it is emphasized again that these walls and partitions are not shown in the perspective view of FIG. 4. The walls or other partitions are arranged to define an uninterrupted hallway or gallery 90 alongside the front or rear surface or facade of the building 1, this gallery extending right along the story concerned to give access to the different apartments or flats in that story (see FIG. 5) and being connected at one end to a landing having staircases and elevator shafts (see FIG. 2). The walls of the gallery 90 and the landing are already provided in the prefabricated building sections and no extensive finishing work is necessary after the assembly of the building sections or room units.

Figure 6:
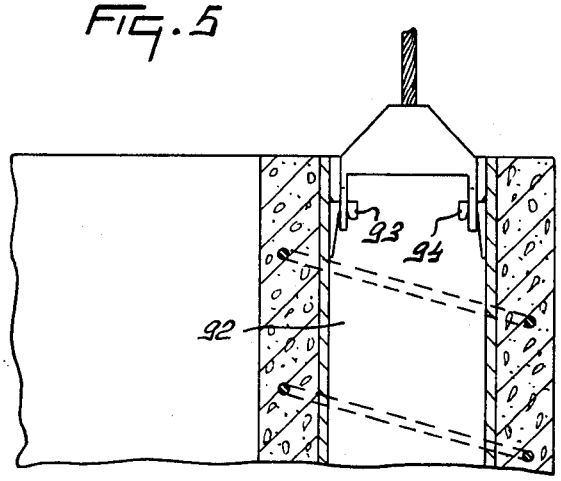
FIG. 6 is a vertical section to an enlarged scale, taken on the line VI—VI in FIG. 4 and illustrates an alternative arrangement for lifting the building sections or room units.

The columns 61 to 66 inclusive have central cores in the form of tubes 92 that may, as illustrated, be of substantially square cross-section. The interiors of these tubes 92 may, if desired, be filled with material such as concrete during or after the assembly of the building sections or room units to form the building 1 at the building site. FIG. 6 of the drawings shows a modification in which the upper end of each tube 92 of each of the "corner" columns 61, 63, 64 and 66 is provided internally with two opposed hooks 93 and 94 adapted for releasable connection to a grappling bracket carried at the end of one of the hoisting cables 45 or 46. When the construction illustrated in FIG. 6 is employed, the grappling brackets can be directly engaged with the opposed hooks 93 and 94 at each of the four corners of each building section or room unit thus making the provision of the supporting assembly 47 unnecessary.

The methods of erecting prefabricated buildings that have been described enable such buildings to be completed efficiently and quickly. The lifting means 4 which is arranged close to one end of the building that is to be erected does not need to be mobile and the supply of prefabricated building sections or room units from a factory or the like can take place efficiently along a predetermined track. After the lifting means 4 has been employed to complete one story of the building, the lifting tower is increased in height and the support 23 of the shifting means is moved upwardly through one story to enable the next story of the building to be tackled. Although the shifting means that has been described comprises the cables 20 that are used to pull the building sections one at a time from the end 14 of the building towards the winch 19 and into their appointed positions in the various stories, this is not essential and it should be noted that it is possible to employ endless chains, cables or the like that may extend between the winch 19 and the end 14 of the building and with which more than one building section can be shifted in a single operation. This is particularly advantageous when a large prefabricated building of considerable length is to be erected.

Although various features of the methods of erection that have been described and illustrated in the accompanying drawings and various features of the equipment and building sections employed in such methods will be set forth in the following claims as inventive features, it is emphasized that the invention is not limited to those features and includes within its scope all of the steps of the methods that have been described or illustrated and all of the pieces of equipment and parts of the building sections that have been described or illustrated both individually and in various combinations.

What we claim is:

1. An improvement in the method of assembling a prefabricated building from a plurality of box-shaped building sections each having dimensions compatible with being transported on highways by transport vehicles, which comprises the steps of performing the functions of: positioning a plurality of said sections to make up one story at the building site, whereby said one story has at least one longer side and at least one shorter side as seen in plan view; disposing overhead lifting means proximate said shorter side, said lifting means including a lifting tower that extends upwardly from ground level positioning one of said transport vehicles carrying one of said sections directly under said lifting means and proximate said shorter side, engaging said one section by said lifting means and elevating same thereby vertically from said transport vehicle to above the height of the next story of the building which is being assembled, whereby its bottom is higher than the adjacent top of said one story; placing said one section on at least one further section of said one story by moving said lifting means laterally to a location whereby said one section is spaced above said further section, lowering and disengaging said one section from said lifting means onto said further section whereby it is received and directly supported at least in substantial part by said further section; and providing said one story with means for further laterally moving said one section, laterally shifting said one section across said one story to its appointed position in said next story by said moving means, and thereafter disengaging said one section from said moving means for the subsequent shifting of further said sections by said moving means to make up said next story, the height of said lifting tower being increased as the erection of the building progresses by elevating said tower and inserting further supports at the foot thereof.

2. A method in accordance with claim 1, wherein said lifting means engages said one section on its top.

3. A method in accordance with claim 2, wherein said lifting means are fastened to said one section for lifting same proximate its top at the four corners thereof.

4. A method as claimed in claim 1, wherein said moving means is attached to a side of the building remote from said shorter side thereof where said lifting means is disposed.

5. A method as claimed in claim 4, wherein said moving means is operatively connected to a said section that is to be displaced thereby at a location on that section which is remote from the side thereof which faces the place said moving means is attached.

6. A method as claimed in claim 4, wherein said moving means includes cables that extend along the longer sides of the building being erected during the operation of said moving means.

7. A method as claimed in claim 1, wherein said foot of said tower is provided with fluid-pressure operated lifting devices selectively elevating said tower for said inserting of further supports at the bottom of said tower.

8. An improvement in the method of assembling a prefabricated building from a plurality of box-shaped building sections each having dimensions compatible with being transported on highways by transport vehicles, the improvement comprising the steps of performing the functions of: positioning a plurality of said sections to make up one story at the building site whereby one story has at least one longer side and at least one shorter side as seen in plan view; disposing overhead lifting means proximate said shorter side, positioning one of said transport vehicles carrying one of said sections directly under said lifting means and proximate said shorter side, engaging one section by said lifting means and elevating same thereby vertically from said transport vehicle to above the height of the next story of the building which is being assembled whereby its bottom is higher than the adjacent top of said one story; placing said one section on at least one further section of said one story by moving said lifting means laterally to a location whereby said one section is spaced above said further section; lowering and disengaging said one section from said lifting means onto said further section whereby it is received and directly supported at least in substantial part by said further section; providing said one story with moving means for further laterally moving said one section, said moving means being attached to a side of the building remote from said shorter side thereof where said lifting means is disposed, laterally shifting said one section across said one story to its appointed position in the next story by said moving means, thereafter disengaging said one section from said moving means for the subsequent shifting of further said sections by said moving means to make up said next story; and upon completion of said next story elevating said moving means by substantially the height of one completed story and releasably connecting same to the just completed story for use in shifting sections of the next story to be erected across the top of said just completed next story.

9. A method as claimed in claim 8, wherein said shifting of each said sections to their appointed positions on said next story is effected substantially horizontally lengthwise along said one story to bring said sections to their appointed positions in said next story.

10. A method as claimed in claim 8, wherein said sections all have substantially the same length and guides are provided on the top to extend partly outboard of said one story whereby they form a channel having a width equal to the length of said sections and said shifting of said sections within the channel formed by said guides.

11. A method as claimed in claim 10, wherein said sections of said one story are initially shifted along further guides carried by a foundation of the building.

12. A method as claimed in claim 10, wherein stories are constructed to overlie said next story and said sections of stories above said next story are shifted within further channels similar to said first mentioned channel formed by guides carried at the top and partly outboard of said overlying stories.

13. An improvement in the method of assembling a prefabricated building from a plurality of elongated box-shaped building sections each having dimensions compatible with being transported on highways as a unit by transport vehicles, which comprises the steps of:

positioning at least five of said sections in a row whereby each section is connected to an adjacent section along a longer side with such longer sides of the sections in a parallel relationship and the shorter sides and top and bottom portions of the sections in substantial alignment, a longer side of an end section of said row of sections comprising a shorter side of the building, and the aligned shorter sides of said sections in a row comprising the front and a longer side of the building;

situating an overhead lifting means proximate a said shorter side of said building, moving a transport vehicle carrying a further elongated section under said lifting means and positioning same whereby the longer sides of said further section are substantially parallel to the longer sides of said sections in a row and the shorter sides of said further section are substantially coplanar with the shorter sides of said sections in a row;

engaging said further section in its upper aspect by said lifting means and elevating said further section directly upwardly whereby its bottom is higher than the height of the tops of said sections in a row, moving said further section laterally by said lifting means whereby it is spaced directly above a top of a said section in said row, and lowering said further section onto the top of such section in said row, providing guide means on the tops of said sections in a row to form a channel for receiving and guiding said further sections and by moving means releasably attached to the shorter side of said row of sections remote from said lifting means, sliding said further section along the tops of said sections in a row within said channel to its predetermined position in the completed building and upon completion of a story of sections so placed on the tops of said sections in a row elevating said moving means the height of one completed story for use in shifting sections of the next story to be erected over the top of the just completed story.

14. An improvement in the method of assembling a prefabricated building from a plurality of elongated box-shaped building sections each having dimensions compatible with being transported on highways as a unit by transport vehicles which comprises the steps of:

positioning a group of at least five of said sections in a row whereby each section is attached to an adjacent section and the group of sections has a rectangular shape as seen from above with the outboard longer sides of opposite sections in the group forming the shorter sides of the rectangle;

positioning overhead lifting means immediately adjacent one of said outboard sides and providing space under said lifting means to receive a transport vehicle carrying a further said section, moving the transport vehicle carrying said further section under said lifting means, engaging said further section in its upper aspect by said lifting means and elevating same thereby from said transport vehicle to where its bottom is higher than the top of the next story of the building being assembled, placing said further section on the top of the nearest section of said row of sections by said lifting means and disengaging said lifting means from said further section whereby said further section is received and supported by said nearest section; and attaching to said further section means for laterally moving it across the tops of said row of sections and by said moving means shifting said further section to its predetermined position on said row of sections in the completed building, said moving means being releasably connected at the shorter side of said row of sections and upon completion of the building story directly above said row of sections, said moving means is elevated one story for use in shifting sections over the tops of such completed story.

15. An improvement in the method of assembling a prefabricated building from a plurality of boxshaped building sections each having dimensions compatible with being transported on highways as a unit by transport vehicles which comprises the steps of performing the following functions:

positioning a plurality of sections at the building site to form a first story of the building assembled;

placing a lifting device immediately adjacent said first story, said lifting device including cables and providing space to receive transport vehicles carrying further sections directly under said cables;

attaching said lifting device to engage the upper aspect of a further section which is supported on the bed of a transport vehicle and lifting said further section vertically by said cables from said transport vehicle to a height whereby the lowest part of said further section is higher than the adjacent top of said first story;

moving said further section laterally to a position spaced above the adjacent top of said first story while supporting it by said cables and then lowering said further section onto said adjacent top of said first story by said cables and disengaging said further section from said lifting device; and engaging said further section by moving means and thereby moving said further section across the tops of said sections of said first story to its predetermined position in the completed building, said moving means being releasably connected at the side of said first story remote from said lifting device and being elevated the height of one story upon completion of the second story for use in moving sections to make up the third story across the second story.

16. An improvement in the method of assembling a multistory prefabricated building from a plurality of elongated box-shaped building sections each having dimensions compatible with being transported on highways as a unit by transport vehicles which comprises the steps of:

positioning a plurality of sections at the building site side by side in a row to form a first story of the building to be assembled whereby the shorter sides of said story comprise longer sides of said sections;

situating lifting means immediately adjacent a shorter side of said first story whereby the lifting means is supported by four columns in a fixed relationship, said lifting means providing space between said column to the building to receive a transport vehicle carrying a further section for the next story of the building, lifting said further section vertically from the transport vehicle by said lifting means and then moving it laterally by said lifting means to a location spaced over the top of said first story, lowering said further section onto said first story and positioning it in its predetermined place thereon in the completed building;

thereafter similarly lifting additional sections by said lifting means and similarly positioning them on said first story until at least the portion of the second story adjacent said lifting means is substantially completed;

raising said lifting means at its bottom by raising said four columns a distance substantially the height of the next story of the building and inserting a further bottom portion comprising four additional column portions at the bottom of said lifting means; and then lifting still further sections and positioning them on the top of said second story by said lifting means substantially to complete a third story of the building at least in the vicinity of said lifting means.

17. An improvement in the method of assembling a prefabricated building from a plurality of box-shaped building sections each having dimensions compatible with being transported on highways as a unit by transport vehicles which comprises the steps of performing the functions of:

positioning a plurality of sections at the building site in a side-by-side relationship to form a first story of the building to be assembled whereby the shorter sides of said story comprise longer sides of said sections;

situating a lifting device immediately adjacent a shorter side of said first story, said lifting device including four columns in a fixed relation to the building and between said columns to receive a transport vehicle carrying a further section, providing above said further section in said lifting device two depending pairs of cables so that they depend perpendicularly relative a horizontal plane containing the top of said further section and substantially intersect the corners of a horizontal rectangle, each pair of said cables being connecting to a supporting assembly and including a pair of hook-like extensions;

engaging the upper aspect of said further section in its forward portion by one pair of said extensions and in its after portion by the other pair of said extensions;

lifting said further section vertically from the transport vehicle by said cables to a height whereby the bottom of said further section is higher than the adjacent top of said first story; and moving said cables with said supporting assemblies and said further section laterally to above said first story and lowering said further section thereon, and disengaging said further section from said supporting assemblies.

18. An improvement in a method of assembling a prefabricated building from a plurality of box-shaped building sections each of which has dimensions suitable for efficient transportation on highways by transport vehicles, the improvement comprising steps performing the functions of: placing and connecting a plurality of said building sections side-by-side at the building site to comprise the ground floor of the prefabricated building; providing adjacent ssaid ground floor a pair of lifting support means and spacing said support means sufficiently apart so that a transport vehicle carrying one of said sections can be driven between said support means, mounting across said support means lifting means at a relative position whereby it can lift one of said sections from a transport vehicle driven between said support means to a height whereby its bottom is higher than the top of the adjacent ground floor structure; installing elevator means in association with said support means adapted to elevate said support means simultaneously a height at least equal to the overall height of said ground floor; driving a transport vehicle carrying one of said sections between said support means and directly under said lifting means, connecting said lifting means to said section carried by said transport vehicle and lifting it therefrom to a height whereby the bottom of said lifted section is above the top of said floor, placing said section on the top of said ground floor by said lifting means, disconnecting said section from said lifting means and by moving means releasably connected to said ground floor opposite said lifting means moving it along the top of said ground floor to its predetermined location in the completed building; removing the transport vehicle which carried said section between said support means and successively bringing further transport vehicles with further said sections, between said support means and repeating the above steps whereby each said further section is moved to its predetermined location on top of said ground floor to complete the second story of the building; removing said moving means from said ground floor and releasably connecting it to said second floor opposite said lifting means for use in completing a third floor of the building; and simultaneously elevating said support means by said elevator means a height which is at least the height of said second floor above said ground floor for the lifting of additional sections to complete a third floor of the building.

19. An improvement in accordance with claim 18, wherein said lifting means upon having lifted a said section higher than said ground floor moves in part with said section laterally over said ground floor and lowers said section directly downwardly.

20. An improvement in accordance with claim 18, wherein said section upon being disconnected from said lifting means is slid across said ground floor to its predetermined location in the completed building by moving means connected to a section opposite said moving means in said ground floor.

21. An improvement in accordance with claim 20, wherein said moving means comprises flexible means connected to the side of the section which it is sliding across the top of said ground floor nearest said lifting means whereby the stresses in the section being moved by reason of said movement are primarily compression stresses.

22. An improvement in accordance with claim 18, wherein the relative directional orientation of all said sections' vertical and horizontal axes remain substantially unchanged from the time each said section is lifted from said transport vehicle until placed in its predetermined location in the completed building.

23. An improvement in a method of assembling a prefabricated building from a plurality of elongated box-shaped building sections each of which is suitably dimensioned for efficient transportation on highways by transport vehicles, the improvement comprising steps performing the functions of:

placing and connecting a plurality of said sections side-by-side at the building site to comprise a floor of the prefabricated building whereby longer sides of said sections comprise shorter sides of the floor;

transporting a further of said sections to adjacent said building site and said floor by one of said transport vehicles;

lifting said further section directly vertically by lifting means situated adjacent a shorter side of said floor from said transport vehicle to a height wherein its bottom is higher than the top of said floor;

moving said further section and said lifting means laterally above said floor and then lowering said further section by said lifting means directly on the top of at least one section of said floor whereby it is supported at least in part by said one section, shifting said further section by moving means releasably connected to said floor opposite said lifting means across the top of said floor; repeating said transporting, lifting, moving and shifting steps for a further plurality of sections to comprise the second floor of the building; and removing said moving means from said first story and elevating and releasably connecting same to said second floor for use in constructing a third floor of the building.

24. An improvement in accordance with claim 23, wherein said moving means comprises winch means mounted on a section of said floor remote from said one section and said one section is connected to a flexible member extending from said winch means, said further section then being slid across the top of said floor by said winch means towards its ultimate location in the completed building.

25. An improvement in accordance with claim 24, wherein the directional orientation of said further section's vertical and horizontal axes remains substantially the same from the time said further section is lifted from said vehicle until it is brought to its ultimate location in the completed building.

26. An improvement in a method of assemblying a multi-story prefabricated building from a plurality of boxshaped building sections each of which is suitably dimensioned for efficient transportation on highways by transport vehicles, the improvement comprising steps performing the functions of:

placing and connecting a first plurality of said sections side-by-side at the building site to comprise a first floor of the prefabricated building;

placing lifting means adjacent one end of said first floors;

transporting a second plurality of said sections to said building site and lifting such sections by said lifting means onto the top of said first floor and moving same across the top of said first floor to their predetermined positions in the completed building whereby a second floor of the building is formed;

elevating said lifting means by approximately the height of one story and inserting supports in the bottom of said lifting means as so elevated; and transporting a third plurality of said sections to said building site and lifting such sections by said elevated lifting means onto the top of said second floor and moving same across the top of said second floor to their predetermined positions in the completed building whereby a third floor of the building is formed.

27. An improvement in accordance with claim 26, wherein said lifting means is elevated approximately the height of one further story by inserting further supports in the bottom of said lifting means and a further floor is constructed from a further plurality of sections in the same manner as said second and third floors were formed.

28. An improvement in accordance with claim 27, wherein said sections for said second, third and fourth floors are moved across the tops of the next lower floors by winch means and flexible means interconnecting each section as it is so moved and said winch means, said winch means being mounted on a section remote from said lifting means in the floor immediately under the floor being formed and said winch means being moved to the next higher section remote from said lifting means when such floor has been substantially formed.

* * * * *